United States Patent [19]

Neff

[11] 4,453,565

[45] Jun. 12, 1984

[54] FOUR-WAY VALVE WITH COVER MOUNTED PRESSURE REGULATING AND FLOW CONTROL VALVE

[75] Inventor: James A. Neff, Bloomfield Township, Oakland County, Mich.

[73] Assignee: MAC Valves, Inc., Wixom, Mich.

[21] Appl. No.: 351,977

[22] Filed: Feb. 24, 1982

[51] Int. Cl.[3] ..... F15B 13/043

[52] U.S. Cl. ..... 137/596; 137/596.16; 137/625.64; 137/625.69; 137/884

[58] Field of Search ..... 137/596, 596.16, 625.64, 137/625.65, 625.66, 625.69, 884, 885

[56] References Cited

U.S. PATENT DOCUMENTS

| | | | |
|---|---|---|---|
| 3,385,166 | 5/1968 | Kroffke | 137/625.6 |
| 3,513,876 | 5/1970 | Tarbox | 137/596 |
| 3,643,683 | 2/1972 | Semon | 137/505.18 X |
| 3,976,279 | 8/1976 | Walker | 251/267 |
| 4,267,862 | 5/1981 | Neff et al. | 137/625.64 |

*Primary Examiner*—Gerald A. Michalsky
*Attorney, Agent, or Firm*—Robert G. Mentag

[57] ABSTRACT

A four-way valve including a valve base, a valve body mounted on a base and a valve cover mounted on the top of the valve body. The valve can be used as a stacking valve. A pressure regulating valve may be selectively mounted on the top of the valve cover and each of the exhaust passageways in the valve may be selectively provided with a flow control valve. The inlet air passages in the valve body are constructed and arranged to convey the inlet air under pressure up around the main valve spool bore and up to the pressure regulating valve, and then down to the main valve spool bore with secondary regulated air pressure. The exhaust air passages are arranged in the valve body so that the flow control valves are in a position where the exhaust air is flowing downwardly through the valve body. The valve includes pilot air passages which may be provided selectively with either external pilot air or internal pilot air.

9 Claims, 14 Drawing Figures

FOUR-WAY VALVE WITH COVER MOUNTED PRESSURE REGULATING AND FLOW CONTROL VALVE

TECHNICAL FIELD

This invention relates generally to the air valve art, and more particularly, to an improved four-way air valve provided with pressure regulating apparatus and flow control valve apparatus carried by a detachable valve cover. The valve can be used in stacks, and it provides a valve wherein the flow control or operating air pressure for each valve in a stack of valves can be individually regulated. The valve of the present invention is adapted for use in an air flow line for controlling and regulating the flow of pressurized air to both ends of an air cylinder, or the like.

BACKGROUND ART

It is well known in the air valve art to provide valves which can be employed in stacks, and wherein the inlet air pressure to each valve is individually controlled. However, the prior art system for sandwiching pressure controls between units in a stack, for each valve in a stack of valves is expensive and bulky. A prior art system for providing individual pressure control means for each valve in a stack of valves includes the mounting of a plate between the valve body and the valve base, which increases the height of the valve substantially because of the large structural configurations of the conventional type pressure regulators employed in such plates, which are normally called sandwich plates. The drastic increase in the height of a valve caused by the use of a sandwich plate is a disadvantage where space for the valve is at a minimum, since it results in an overall larger valve. The use of a sandwich plate is also disadvantageous when a predetermined dimensional control must be maintained between a valve body and a valve base, or where certain connections are made between a valve body and a valve base, such as electrical connections. Flow control valves have been used before in exhaust ports in more complicated structures, as in U.S. Pat. Nos. 2,912,007 and 2,992,511.

DISCLOSURE OF THE INVENTION

In accordance with the present invention, a four-way flow control air valve is provided which has pressure regulating and flow control valve means operatively mounted in a detachable valve cover. The valve can be used individually or in a stack of valves, and each of the valves in the stack may be provided with pressure regulating and flow control means, which are compact and economical, and which are adapted to be employed to individually or in combination control and regulate the air pressure in each valve. The valve can also be used as a standard four-way valve without flow control or pressure regulation. The valve of the present invention is constructed and arranged so that the pressure regulating and flow control valve means may be mounted in the top cover of some of the valves in a stack of valves, and yet not be employed in other valves in the stack of valves. The addition of pressure regulating and flow control valve means to a valve of the present invention in a stack can be quickly and easily accomplished, and without substantially changing the overall basic height of the valve, which is advantageous since it is possible to maintain the structural hookup or connection relationship between all of the valves, including the air pressure inlet, cylinder ports, exhaust ports and electrical connections.

BEST MODE OF CARRYING OUT THE INVENTION

Figure 1:
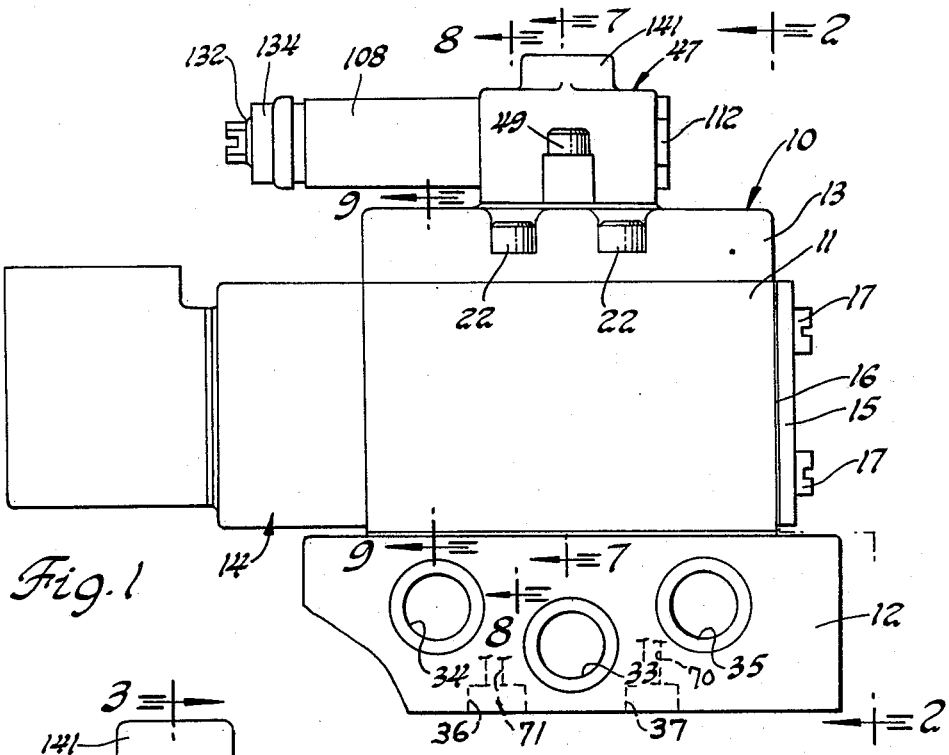
FIG. 1 is a side elevation view of a first embodiment of a four-way air valve with cover mounted pressure regulating and flow control valves made in accordance with the principles of the present invention.
Figure 3:
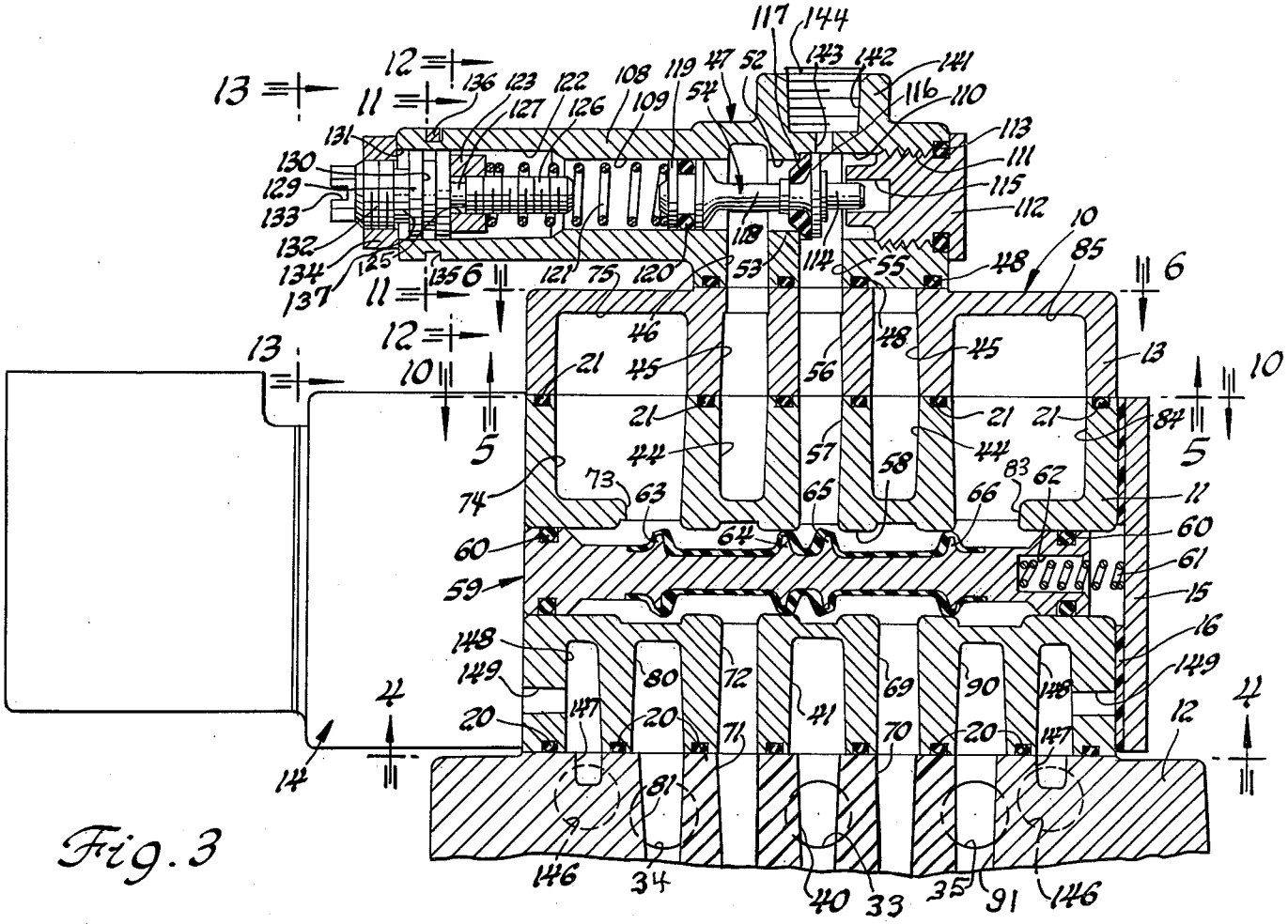
FIG. 3 is an enlarged, elevational section view, with parts broken away, of the valve structure illustrated in FIG. 2, taken along the line 3—3 thereof, and looking in the direction of the arrows.

Referring now to the drawings, and in particular to FIGS. 1 and 3, the numeral 10 generally designates a four-way valve, with cover mounted pressure regulating and flow control valves made in accordance with the principles of the present invention.

Figure 2:
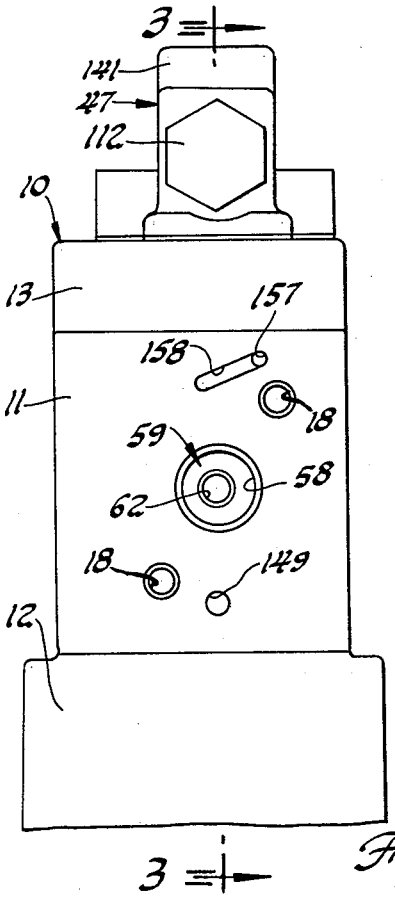
FIG. 2 is a right side elevation view of the valve structure illustrated in FIG. 1, taken along the line 2—2 thereof, and looking in the direction of the arrows.

The valve 10 includes a valve body 11 which is seated on a valve base 12. The upper end of the valve body 11 is enclosed by a suitable valve body cover 13. A conventional solenoid operated pilot valve assembly, generally indicated by the numeral 14, is operatively mounted on the left end of the valve body 11. The solenoid 14 may be of any suitable type which provides solenoid controlled pilot air or pilot air operated means for shifting the main valve spool in the body 11, as described more fully hereinafter. The solenoid 14 may also be of the type which directly operates the main valve spool in the valve spool bore of the valve. As shown in FIGS. 1 and 3, the right end of the valve body 11 is enclosed by a suitable valve body end plate 15 and gasket 16. The valve body end plate 15 is releasably secured to the valve body 11 by suitable machine screws 17 (FIG. 1) which are threadably engaged in suitable threaded bores 18 in the valve body 11 (FIG. 2).

Figure 9:
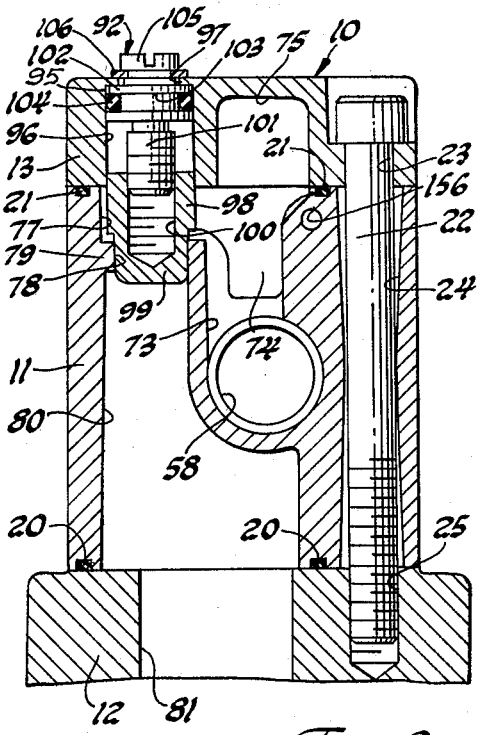
FIG. 9 is a fragmentary, enlarged, elevational section view of the valve structure illustrated in FIG. 1, taken along the line 9—9 thereof, and looking in the direction of the arrows.
Figure 5:
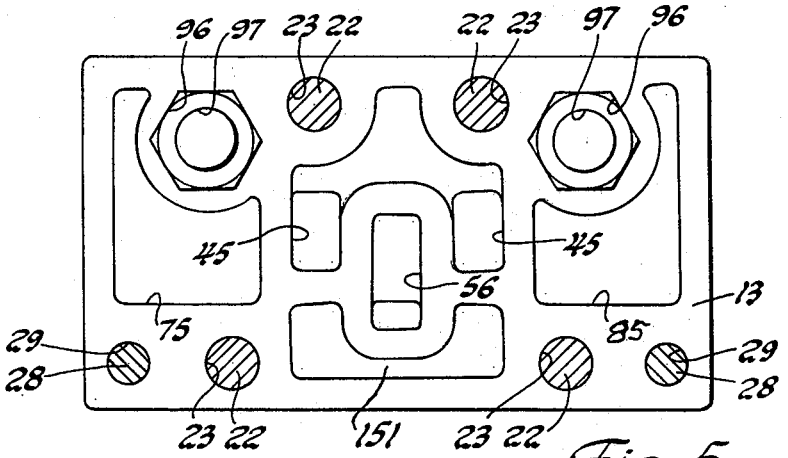
FIG. 5 is a bottom view of the valve cover structure illustrated in FIG. 3, taken along the line 5—5 thereof, and looking in the direction of the arrows.
Figure 6:
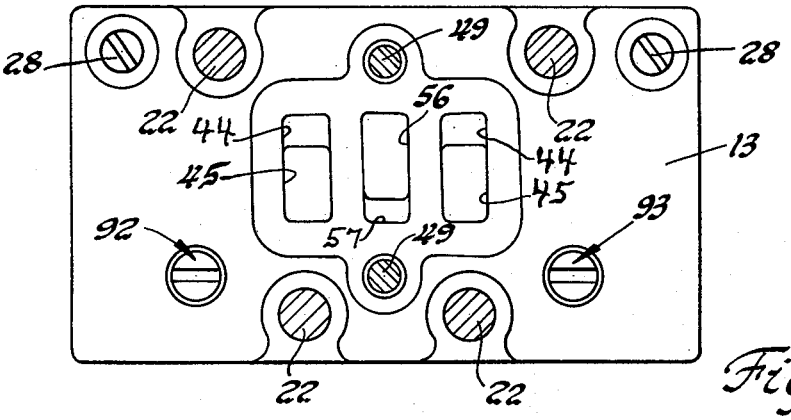
FIG. 6 is a top plan view of the valve cover structure illustrated in FIG. 3, taken along the line 6—6 thereof, and looking in the direction of the arrows.
Figure 10:
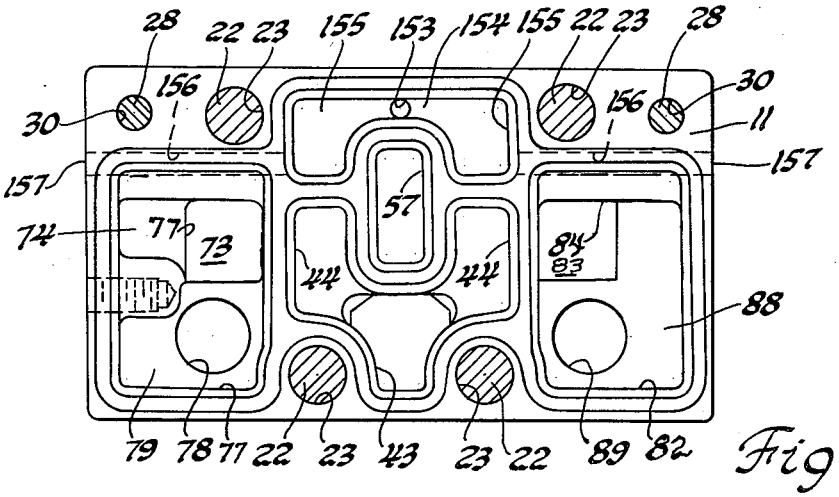
FIG. 10 is a top plan view of the valve body structure illustrated in FIG. 3, taken along the line 10—10 thereof, and looking in the direction of the arrows.

As best seen in FIG. 9, the valve body 11 is provided with suitable seals 20 and 21, on the lower and upper ends thereof, for sealing engagement with the base 12 and cover 13, respectively. The valve body 11, base 12 and cover 13 are releasably secured together by suitable bolts 22 which pass through suitable bores 23 and 24 in the cover 13 and valve body 11, respectively, and thence into threaded engagement with threaded bores 25 in the upper side of the base 12. As shown in FIGS. 5, 6 and 10, the valve cover 13 is also secured to the valve body 11 by a pair of suitable machine screws 28 which extend through suitable bores 29 in the valve cover 13 and into threaded engagement in threaded bores 30 in the valve body 11.

Figure 7:
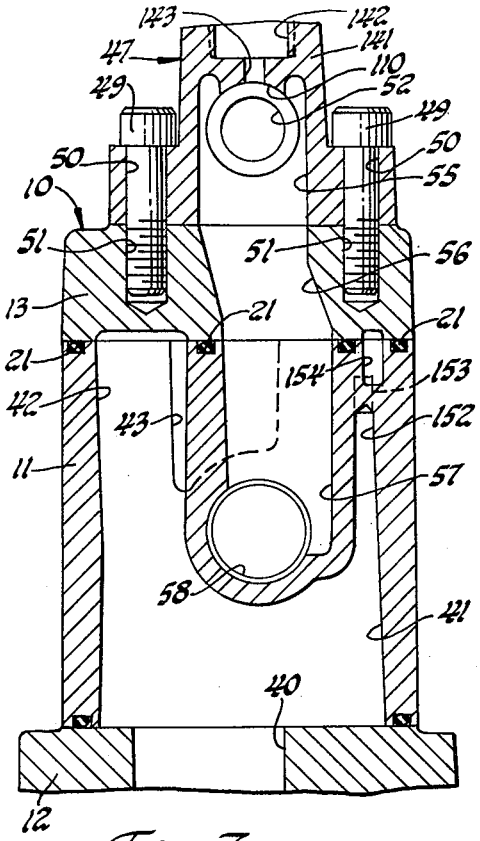
FIG. 7 is a fragmentary, enlarged, elevational section view of the valve structure illustrated in FIG. 1, taken along the line 7—7 thereof, and looking in the direction of the arrows.
Figure 8:
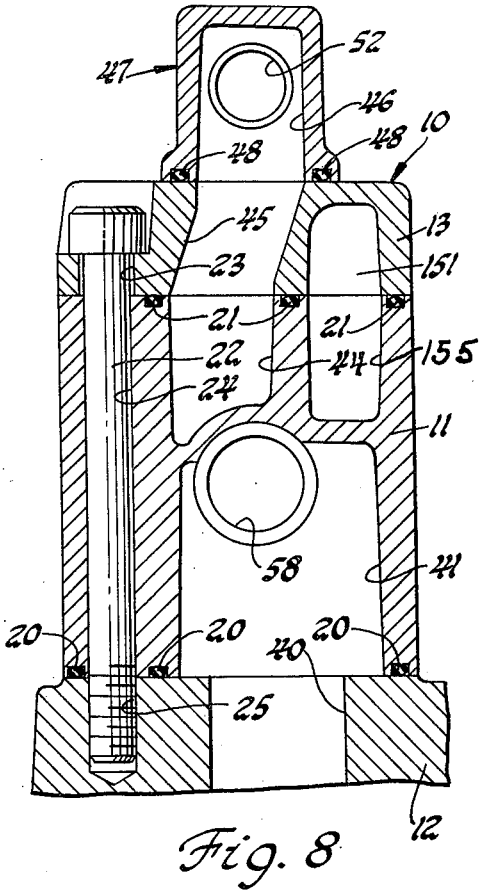
FIG. 8 is a fragmentary, enlarged, elevational section view of the valve structure illustrated in FIG. 1, taken along the line 8—8 thereof, and looking in the direction of the arrows.

As illustrated, the base 12 is provided with a suitable inlet port 33 which admits air under pressure into a passage 40 in the base 12. The passage 40 communicates at its upper end with a passage 41 in the valve body 11. As shown in FIG. 7, the passage 41 is formed so as to extend upward around the valve bore 58 in which is slidably mounted the main valve spool 59 (FIG. 3). The upwardly extended portion of passage 41 is designated by the numeral 42, and it communicates with a central passage 43 in the upper end of the valve body 11. As shown in FIG. 10, the upper end of the passage 43 communicates at the sides thereof with two laterally spaced apart vertical passages 44. As shown in FIG. 10, the passages 44 are in communication with each other. As shown in FIGS. 3 and 8, the upper end of each of the passages 44 in the valve body 11 communicates with the lower end of an upwardly extended passage 45 that extends upwardly through the valve cover 15.

As shown in FIGS. 1 and 3, a pressure regulating valve, generally indicated by the numeral 47, is operatively mounted on the top of the valve cover 13, and it is releasably secured thereto by suitable machine screws 49. As shown in FIG. 3, suitable seal members 48 are operatively mounted between the lower end of the pressure regulating valve 47 and the upper end surface of the valve cover 13. As shown in FIG. 7, the machine screws 49 extend downwardly through bores 50 in the pressure regulating valve 47 and into threadable engagement with threaded bores 51 which are formed in the upper end of the valve cover 13.

As shown in FIG. 3, the pressure regulating valve 47 includes a body 53 which is positioned with a transverse passage 46 in communication with one of the primary air pressure passages 45 in the valve cover 13. The pressure regulating valve body passage 46 communicates with a longitudinal valve spool bore 52 in the valve body 53. The valve spool bore 52 communicates with a transverse passage 55 in the regulating valve body 53 which communicates with the upper end of a secondary passage 56 in the valve cover 13. The flow of pressurized air between the primary air pressure passage 46 and the secondary air pressure passage 55 is controlled by a regulator valve spool element, generally indicated by the numeral 54, as explained more fully hereinafter. The secondary air pressure passage 56 communicates with a passage 57 in the valve body 11 which in turn communicates with the main spool valve bore 58 in the valve body 11.

As shown in FIG. 3, the valve 10 of the present inven invention includes a conventional main valve spool, generally indicated by the numeral 59, which is movably mounted in the valve spool bore 58. The valve spool 59 is provided with an O-ring seal 60 at each end thereof. The valve spool 59 is maintained in its initial position, shown in FIG. 3, by a return spring 61 which has its inner end seated in an axial bore 62 formed in the right end of the valve spool 59, as shown in FIG. 3. The outer end of the return spring 61 is seated against the inner face of the valve body end plate 15.

The valve spool 59 is provided with a plurality of usual annular valve elements 63, 64, 65 and 66, for controlling the flow of air under pressure through the valve 10. As shown in FIG. 3, when the valve spool 59 is in the initial position, with the solenoid 14 de-energized, the secondary or regulated air pressure flows downward from the passage 57 and through the valve bore 58 and down through a passage 69 and into a cylinder passage 70 in the valve base 12. The cylinder passage 70 is connected to a cylinder port in the bottom end of the valve base 12 as illustrated by the numeral 37 in FIG. 1. The annular valve element 66 blocks communication between the cylinder port 37 and the passage 83 to the exhaust chamber 84. The annular valve element 64 blocks communication between the secondary or regulated air pressure passage 57 and a cylinder passage 72 in the valve body 11, which is connected to a cylinder passage 71 in the valve base 12. The cylinder passage 71 in the valve base 12 is connected to another cylinder port 36, as illustrated in the bottom end of the valve base 12 as indicated in FIG. 1. If desired, the cylinder ports 36 and 37 could be formed in the ends of the valve base 12. In the initial position shown in FIG. 1, the valve spool 59 is positioned to allow exhaust air to flow, from a cylinder being controlled, into the cylinder port 36 and through the passages 71 and 72, and through the bore 58, into the exhaust passage 73 and into the exhaust chamber 74. When the solenoid 14 is energized to move the valve spool 15 to the right, against the pressure of the return spring 61, the aforedescribed flow conditions are reversed.

As shown in FIG. 3, the upper end of the exhaust chamber 74 is enclosed by a chamber 75 formed in the valve cover 13. As shown in FIG. 9, the exhaust chamber 74 communicates with an offset exhaust passage 77. The lower end of the exhaust passage 77 is enclosed by a horizontal wall 79 through which is formed an exhaust valve bore 78. The valve bore 78 communicates at its lower end with an exhaust passage 80 that is formed in the valve body 11. The exhaust passage 80 is connected to an exhaust passage 81 in the valve base 12. The exhaust passage 81 communicates with a transverse exhaust passage which has an exhaust port 34 on each side of the valve base 12, for stacking purposes.

Figure 4:
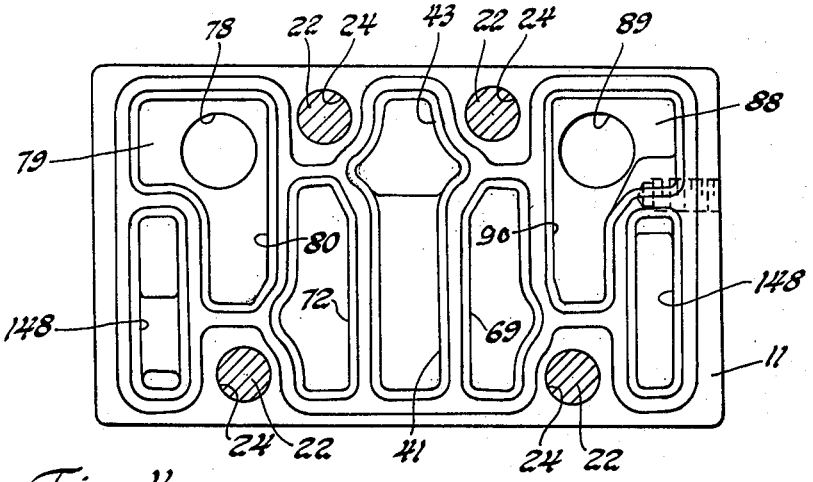
FIG. 4 is a bottom view of the valve body structure illustrated in FIG. 3, taken along the line 4—4 thereof, and looking in the direction of the arrows.

The other exhaust passage 84 is enclosed on its upper end by a chamber 85 which is formed in the valve cover 13, as shown in FIG. 3. The exhaust passage 84 also has an offset portion 82 (FIG. 10) which is enclosed by a horizontal wall 88 through which is formed an exhaust valve bore 89 is the same as the first described exhaust bore 78 for the first described exhaust passage 74. As shown in FIG. 4, the exhaust valve bore 89 communicates with an exhaust passage 90 in the valve body 11. The exhaust passage 90 communicates with an exhaust passage 91 in the valve base 12, as shown in FIG. 3. The exhaust passage 91 communicates with a transverse exhaust passage which has an exhaust port 35 on each side of the valve base 12, for stacking purposes. It will be understood that the valve base 12 has an inlet port 33 on each side of the valve base 12, for stacking purposes.

The flow of exhausting air through the bore 78 is controlled by a flow control valve, generally indicated by the numeral 92. As shown in FIG. 6, the flow of air exhausting through the other exhaust bore 89 is also controlled by an identical flow control valve, generally indicated by the numeral 93. The structural details of the flow control valve 92 are illustrated in FIG. 9 and valve 92, will be described in detail. It will be understood that the flow control valve 93 is identically constructed and it operates in the same manner as the flow control valve 92.

As shown in FIG. 9, the exhaust chamber portion 74 is enclosed by the valve cover 13 which has formed therein a hole 96 which is formed with a hexagonal cross sectional shape. Slidably mounted in the hexagonal shaped hole 96 is an elongated valve body 98 which has a hexagonal shaped outer surface that is slidably mounted in the hexagonal shaped hole 96 (FIG. 5). The hexagonal shaped body 98 has integrally formed on the lower end thereof a valve element 99 which has an outer rounded surface that is tapered slightly downwardly and inwardly, and it is adapted to be seated in the bore 78 so as to be moved between a position wherein the valve element 99 fully closes the bore 78, or closes it to a desired amount to provide a predetermined exhaust air flow. The hexagonal valve body 98 that carries the valve element 99 is moved upwardly and downwardly, to selective position of the valve 99 in the bore 78, by means of a threaded valve stem 101 which is threadably mounted in an axial threaded bore 100 in the upper end of the valve body 98. Integrally formed on the upper end of the threaded valve stem 101 is an enlarged diameter flange 102 which is rotatably mounted in a circular bore 95 that is formed immediately above the hexagonal shaped hole portion 96. The valve stem flange 102 is provided with an annular groove 103 in which is operatively mounted an O-ring seal 104. Integrally attached to the upper end of the valve stem flange 102 is a valve shaft 105 that extends outwardly of the valve cover 13 through a bore 97. A releasable retainer ring 106 is operatively mounted in an annular groove around the outer end of the valve stem extension shaft 105 to releasably secure the threaded valve stem 101 in position, to allow rotational movement of the valve stem 101 and prevent longitudinal movement of the same, when the valve stem 101 is rotated. It will be seen that the flow control valve 92 is of the non-rising type, whereby the overall height of the valve is not changed when the flow control valve 92 is opened and closed. It will be understood that the mating hexagonal hole 96 and the outer surface of the valve body 98 may be made to some other non-circular form, other than a hexagonal form to prevent rotation of the same.

As shown in FIGS. 1 and 3, the pressure regulating valve 47 is provided with an integral, horizontally disposed, elongated spring body 108 which is provided with a central bore 109 that communicates with one end of the valve bore 52 in the valve body 53. A slightly enlarged bore 110 is formed in the valve body 53 and it communicates with the other end of the valve bore 52. The outer end of the valve body bore 110 is threaded, as indicated by the numeral 111, and it has threadably mounted therein a threaded plug 112 which is provided with a suitable O-ring seal 113.

The pressure regulating valve element 54 includes a cylindrical end shaft 114 which is slidably extended into an axial bore 115 formed in the inner end of the plug 112. The pressure regulating valve element 54 further includes a central elongated shaft 118. Integrally formed between the valve element shaft portions 114 and 118 is an annular flange 116 that carries a conical valve element 117 for engagement with a valve seat formed at the junction of the valve bore 52 and the valve bore 110, for regulating the secondary air pressure passing down into the passage 55. The pressure regulating valve 54 further includes an enlarged diameter, integral annular flange 119 which is integrally formed on the left end of the valve stem or shaft 118, as viewed in FIG. 3. The valve flange 119 is slidably mounted in the bore 109, and it is provided with an annular groove in which is seated a suitable O-ring seal 120.

Figure 12:
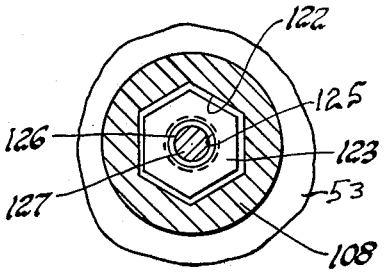
FIG. 12 is a fragmentary, elevational section view of the regulating valve structure illustrated in FIG. 3, taken along the line 12—12 thereof, and looking in the direction of the arrows.
Figure 13:
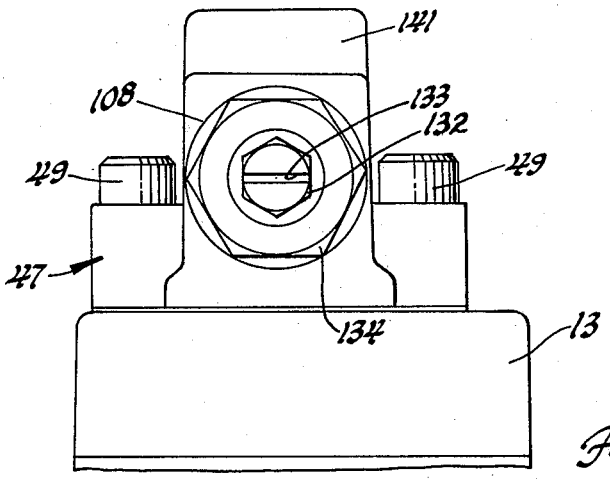
FIG. 13 is a fragmentary, enlarged, elevational left end view of the regulating valve structure illustrated in FIG. 3, taken along the line 13—13 thereof, and looking in the direction of the arrows.

As shown in FIG. 3, a pressure regulating spring 121 is operatively mounted in the spring body 108 with its inner end position in the bore 109, and its outer end in an enlarged longitudinal hole 122 which communicates with the bore 109. The inner end of the spring 121 abuts the flange 119 of the pressure regulating valve element 54. The outer end of the spring 121 is seated against a nut 123. The nut 123 is provided with an hexagonal shaped outer periphery. As shown in FIG. 12, the hole 122 is also shaped with a mating hexagonal surface so as to restrict the nut 123 from rotation. A spring pressure adjusting screw 126 is threadably mounted through a threaded bore 125 formed axially through the nut 123. The outer end of the adjusting screw 126 is integrally attached to a reduced diameter shaft 127 which has its outer end integrally attached to an enlarged annular flange 129 that is provided with an annular groove 130. The annular flange 129 is rotatably mounted in a cylindrical bore 131 which terminates at its inner end at the outer end of the hexagonal shaped hole 122. A threaded shaft 132 is integrally attached by a reduced diameter shaft 137 to the outer side of the annular flange 129. The shaft 132 is provided with an outer end extension in which is formed a slot 133 for adjusting the threaded shaft 126. A lock nut 134 is threadably mounted around the shaft 132 for locking the same in a rotatably adjusted position.

Figure 11:
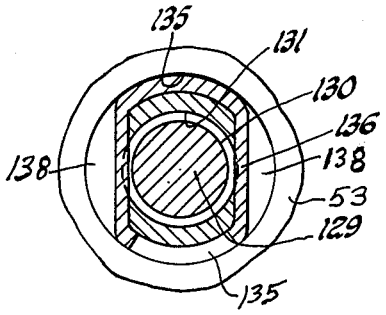
FIG. 11 is a fragmentary, elevational section view of the pressure regulating valve illustrated in FIG. 3, taken along the line 11—11 thereof, and looking in the direction of the arrows.

As shown in FIGS. 3 and 11, a groove 135 is formed in the outer periphery of the spring body 108, on each of the upper and lower sides thereof. The grooves 135 communicate with a pair of side slots 138 as shown in FIG. 11. A U-shaped releasable retainer ring 136 is adapted to be inserted down through the side slots 138 and have a bight portion seated in the upper groove 135. As shown in FIG. 11, the side legs of the U-shaped retainer ring 136 are extended or seated in the annular groove 130 formed in the flange 129 to permit rotation of the adjusting screw 126 without longitudinal movement of the same.

As shown in FIG. 3, the pressure regulating valve body 53 is provided on the upper end thereof with an upwardly extended annular projection 141 in which is formed a threaded bore 142. The inner end of the threaded bore 142 is connected by a small diameter bore 143 to the bore 110 which is connected to the secondary air pressure passage 55. A suitable air gage may be operatively mounted in the threaded bore 42 to allow an operator to monitor the secondary air pressure, or the threaded bore 142 may be closed by a suitable threaded plug, generally indicated by the numeral 144.

As illustrated in FIG. 3, valve base 12 may be provided with a pair of transverse pilot air passages 146 which would be connected to an external source of pilot air, and which could be connected to similar passages in adjacent valves if the valve 10 were used in a stack of valves. The pilot air passages 146 are each connected to a passage 147 in the valve base 12, which in turn communicated with a pilot air passage 148 in the valve body 11. A pilot air passage 149 connects each of the pilot air passages 148 to a solenoid, as the solenoid 14, and selectively, if desired, to the chamber for return spring 61 to provide an air assist return.

As shown in FIG. 10, a pair of pilot air passages 155 are formed in the valve body 11, and they are connected by a narrow passageway 154 (FIGS. 7 and 10). The upper ends of the pilot air passages 155 are enclosed by the valve cover 13, which has a mating chamber 151 that extends over the two air passages 155 and the connection passage 154. As shown in FIG. 7, the inlet air pressure chamber 41 has an upwardly disposed extension 152 on one side of the valve bore 58. Inlet primary air pressure may be conveyed to the pilot air passages 155 through the connection passage 154 by drilling a hole 153 (FIG. 7) through the valve body 11 to connect the passage 152 with the passage 154. The last described structure provides an internal supply of pilot air which can be conveyed from the air passages 155 through a pair of bores 156 (FIG. 10), and out through ports 157 to a passage 158 on each end of the valve body 11, as shown in FIG. 2, and thence into an adjacent solenoid operated pilot valve.

In use, the valve 10 of the present invention may be used as an individual unit or in a stack of valves. The valve 10 is constructed and arranged so that it can be used to regulate and control the inlet or primary air pressure individually to every valve in a stack of valves to feed different inlet pressures to various valves in a stack of valves. The flow passages through the valve structure are constructed and arranged so that the valve 10 can be quickly and easily provided with the pressure regulating valve 47, if desired, or the pressure regulating valve 47 can be deleted if it is desired to employ the air pressure from an air pressure source without regulating the same. It will also be seen that the valve 10 of the present invention includes the flow control valves 92 and 93 which may be employed, or not employed. It will also be seen that the flow control valves 92 and 93 are positioned in an off-center manner, relative to the valve bore 58, so as to provide adjusting space for both the centrally located pressure regulating valve 47 and the flow control valves 92 and 93.

It will be seen from the foregoing, that the valve 10 of the present invention is very flexible in that it permits the selective use of individual pressure regulating means for each valve in a stack, and the selective use of flow control valves for each valve in a stack because the flow control valves are operatively mounted in the valve cover 13. The structure of valve 10 permits the pressure regulating valve 47 and the flow control valves 92 and 93 to be employed without mounting said valves between units in a stack, and without the need for any sandwich plate between the body and the base, which would increase the height substantially. The structure of valve 10 is advantageous since it permits the use of pressure regulating means and flow control means without having to disturb any electrical connections and dimensional controls between the body and the base of the valve.

FIG. 3 shows the pressure regulating valve 47 mounted with the spring body 108 positioned to the left. However, it will be understood that the pressure regulating valve 47 could be turned 180°, since the mounting for the same is symmetrical on the top of the valve cover 13, and the inlet primary air pressure could then be fed up to the valve 47 through the right inlet air passage 45, as viewed in FIG. 3.

In use, it will be seen that the inlet primary air pressure is brought upwardly around the valve spool bore 58, and up into the pressure regulating valve 47 where the desired secondary air pressure can be obtained by adjusting the pressure on the spring 121, so as to provide the desired secondary air pressure in the inlet passage 56 which carries the secondary or regulated air pressure down to the valve spool bore 58 for directional flow control by the valve spool 59, in the usual manner, when the solenoid 14 is de-energized or energized. The flow control valves 92 and 93 can be adjusted to provide the necessary control over the exhaustion of the air from either end of an air cylinder for controlling the speed of an air cylinder in either direction.

Figure 14:
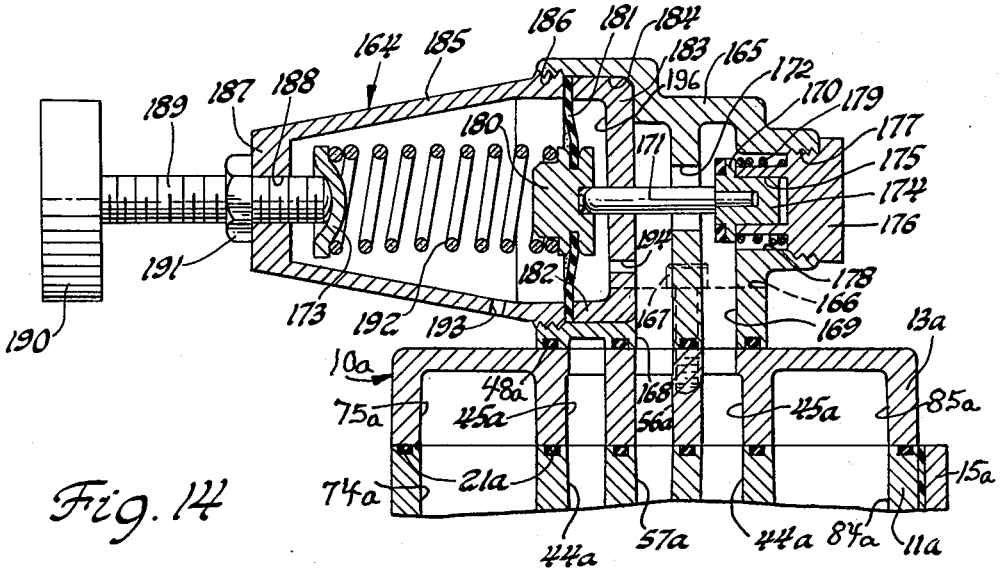
FIG. 14 is a fragmentary, elevational section view of a second embodiment of a regulating valve employed in the invention.

FIG. 14 illustrates a second type of pressure regulating valve which may be employed with the valve 10. The pressure regulating valve illustrated in FIG. 14 is generally indicated by the numeral 164, and it is a diaphragm type regulator. The parts of the valve structure illustrated in FIG. 14 which are the same as the previously described valve structure for the embodiment of FIGS. 1 through 13 have been marked with the same reference numerals, followed by the small letter "a".

The diaphragm type pressure regulating valve 164 includes a body 165 which is provided with a pair of mounting projections or shoulders 166, that are secured to the top of the valve plate **13*a* by suitable machine screws 167. The valve body 165 is provided with a primary air pressure inlet passage 169, which communicates with a longitudinal bore 172 in the pressure regulating valve body 165. The bore 172 communicates with a secondary air pressure passage 168, which communicates with the secondary air pressure passages 56*a* and 57*a* that communicate with the main valve bore in the valve 10*a***.

The pressure regulating valve 164 includes a valve element 170 which is adapted to regulate the flow of inlet pressurized air from the primary air inlet passage 169. The valve element 170 is fixedly mounted on one end of a shaft 171, and it is provided with an elastomeric annular portion of the front end for engagement with one end of the bore 172. The valve element 170 includes an axially extended cylindrical shaft member 174 on the rear end thereof, which is slidably mounted in a bore 175 formed in the inner end of a plug 176 that is threadably mounted in a threaded bore 177 in the rear or right end, as viewed in FIG. 14, of the valve body 165. A spring 179 is mounted around the inner end of the plug 176, in an unthreaded axial bore 178 which terminates at the inner end of the threaded bore 177 in the valve body 165. The spring 179 has the outer end abutting against a shoulder on the plug 176, and the inner end abutting against an annular shoulder on the valve element 170.

The spring 179 tends to normally bias the valve element 170 to the spring 179 tends to normally bias the valve element 170 to the left, as viewed in FIG. 14, to a seating engagement against the right end of the bore 172.

As shown in FIG. 14, the shaft 171 has a rounded end, on the left end thereon, as viewed in FIG. 14, which abuts a centrally disposed spring abutment member 180. The spring abutment member 180 is centrally mounted in a circular, resilient diaphragm member 181. As shown in FIG. 14, the left or rear end of the body 165 is provided with a cylindrical opening 184 in which is seated a cup-shaped member that has a transverse wall 183, and an integral outer cylindrical wall 182. The diaphragm member 181 which carries the spring abutment member 180, has its outer periphery seated against the outer end of the cup-shaped member's side wall 182, and it is held in position by the right end of a spring chamber body 185. The spring chamber body 185 is conical in shape, and it is open on the right or inner end thereof. The open right end of the spring chamber body 185 is threadably mounted in the outer threaded portion 186 of the cylindrical opening 184 in the valve body 165. The spring chamber body 185 is enclosed at its left or outer end by an end wall 187, which has a threaded bore 188 through which is threadably mounted an adjustment screw 189. The adjustment screw 189 has an adjustment knob 190, mounted on the outer end thereof, and it is held in an adjusted position by a suitable lock nut 191. The inner end of the adjusting screw 189 has its inner end abutting an outer spring abutment 173. A coil spring 192 is operatively mounted between the inner and outer spring abutment pads 180 and 173, respectively. The spring chamber inside of the body 185 is designated by the numeral 195, and it is in communication with the atmosphere through a small bore 193. The chamber 196 between the diaphragm 181 and the cup-shaped member wall 183 is in communication through a bore 194 with the secondary air pressure passage 168 in the valve body 165.

It will be seen that the pressure regulating valve 164 of FIG. 14 is adapted to function with the valve **10*a* in the same manner as described hereinbefore for the first embodiment pressure regulating valve 47. The diaphragm type pressure regulating valve 164** is a conventional type regulating valve, and it will be understood that other conventional types of pressure regulating valves may be employed as, for example, a pilot operated regulating valve.

While it will be apparent that the preferred embodiments of the invention herein disclosed are well calculated to achieve the results aforestated, it will be appreciated that the invention is susceptible to modification, variation and change.

INDUSTRIAL APPLICABILITY

A four-way valve with cover mounted pressure regulating and flow control valves adapted for use in industrial air use applications where a reduced downstream pressure is desired, and flow control operations are desired. For example only, said valve may be used for connection to an air cylinder for controlling the operation of the air cylinder, which would be employed in various types of industrial machines.

I claim:

1. A four-way air valve which includes a valve base, a valve body mounted on said base, a valve cover mounted on the top end of the valve body, and with said valve body having an axially movable main valve spool operatively mounted therein in a main valve spool bore and movable between first and second flow control positions to control the flow of pressurized air from an air supply passage means in the valve base to a selected one of a pair of cylinder air passages in the valve body while simultaneously controlling the exhaust of air under pressure from the other cylinder air passage to a selected one of a pair of exhaust chambers, and means for moving the valve spool from the first flow control position to the second flow control position, and back to said first flow control position, characterized in that:

(a) said valve base, valve body, and valve cover have communicating inlet air passages formed therein for the reception of inlet air under a primary pressure from said air supply passage means in the valve base, with the lower end of the inlet air passage in the valve body communicating with the upper end of the inlet air passage in the valve base, and said inlet air passage in the valve body is extended around and upwardly above said main valve spool bore and into a position where it is divided into a pair of upper inlet air passages that are laterally spaced apart and extend upwardly through the upper end of the valve body and through the valve cover, a downwardly directed inlet air passage is formed from the exterior side of the valve cover and downwardly therethrough and through the upper end of the valve body in a position between the two aforementioned pair of upwardly directed upper inlet air passages and downwardly into communication with said main valve spool bore for directional flow control of pressurized air by the movable valve spool into a selected one of the cylinder air passages which extend downwardly from the main valve spool bore through the valve body and valve base and to cylinder ports in the valve base;

(b) said pair of exhaust chambers are each formed partially in the valve body and partially in the valve cover in positions above the main valve spool bore, and they are each connected by an exhaust air passage which conveys air exhausting from a cylinder air passage through the main valve spool bore, in a direction upwardly through the exhaust chamber and then downwardly through the valve body and the valve base, and out through an exhaust port in the valve base; and, (c) a pressure regulating valve is mounted on the top of said valve cover and it blocks flow through one of said pair of upwardly directed inlet air passages and communicates with the other of said pair of upwardly directed inlet air passages and said downwardly directed inlet air passage for regulation of the primary inlet air pressure entering the pressure regulating valve from said other of said pair of upwardly directed inlet air passages to provide a flow of regulated secondary air pressure down into the main valve spool bore.

2. A four-way air valve as defined in claim 1, characterized in that:

(a) said pressure regulating valve is provided with a non-rising stem.

3. A four-way air valve as defined in claim 2, characterized in that said non-rising stem pressure regulating valve includes:

(a) a regulating valve element mounted in a regulating valve body;

(b) an elongated spring is operatively mounted in said last named valve body for providing a regulated spring load on the regulating valve; and, (c) an adjusting valve stem means for adjusting the load on said spring is mounted in said last named valve body.

4. A four-way air valve as defined in claim 3, characterized in that said adjusting valve stem means includes:

(a) a rotatable adjusting screw mounted in said pressure regulating valve body and adapted to engage said spring;

(b) an adjusting screw shaft rotatably mounted in said pressure regulating valve body; and, (c) means for restraining said adjusting screw shaft from moving axially when it is rotated to move said adjusting screw axially.

5. A four-way air valve as defined in claim 1 characterized in that:

(a) a flow control valve is mounted in at least one of said exhaust air passages, in the portion that extends downwardly through the valve body from at least one exhaust chamber, for controlling the flow of air exhausting from the last named exhaust chamber.

6. A four-way air valve as defined in claim 5, characterized in that:

(a) a flow control valve is mounted in the other one of the exhaust air passages, in the portion which extends downwardly through the valve body from the other exhaust chamber, for controlling the flow of air exhausting from the other exhaust chamber.

7. A four-way air valve as defined in either one of claims 5 or 6, characterized in that:

(a) said flow control valve is provided with a non-rising adjusting stem.

8. A four-way air valve as defined in claim 6, characterized in that:

(a) the pressure regulating valve is centrally disposed relative to the transverse axis of the valve cover with its longitudinal axis on the longitudinal axis of the valve cover; and, (b) each of said flow control valves is disposed in a position laterally offset from the longitudinal axis of the pressure regulating valve.

9. A four-way air valve as defined in claim 1, characterized in that:

(a) said valve base and valve body are provided with pilot air passages for selective connection to a source of pilot air for supplying pilot air to a solenoid operated pilot valve means for moving the valve spool between said first and second flow control positions.

* * * * *

UNITED STATES PATENT OFFICE

CERTIFICATE OF CORRECTION

Patent No. 4,453,565 Dated June 12, 1984

Inventor(s) James A. Neff

It is certified that error appears in the above-identified patent and that said Letters Patent are hereby corrected as shown below:

Column 7, line 15 - "communicated" should be --communicates--

Signed and Sealed this

Thirtieth Day of October 1984

[SEAL]

*Attest:*

GERALD J. MOSSINGHOFF

*Attesting Officer*

*Commissioner of Patents and Trademarks*